US005913514A

United States Patent [19]

Moser et al.

[11] Patent Number: 5,913,514

[45] Date of Patent: Jun. 22, 1999

[54] NON-MARKING COLLECTOR APPARATUS AND METHOD

[75] Inventors: James R. Moser, Easton; Jack H. Shaneberger, Bath; Donald Dudash, Easton, all of Pa.

[73] Assignee: Bell & Howell Mail Processing Systems, Durham, N.C.

[21] Appl. No.: 08/754,073

[22] Filed: Nov. 20, 1996

[51] Int. Cl.[6] ..... B65H 5/02

[52] U.S. Cl. ..... 271/273; 271/198; 271/214; 271/220; 414/789.9; 414/790.2

[58] Field of Search ..... 414/789.9, 790.2, 414/790.7, 790.8; 271/35, 198, 213, 214, 220, 273, 274, 275

[56] References Cited

U.S. PATENT DOCUMENTS

| | | | |
|---|---|---|---|
| Re. 31,684 | 9/1984 | Yeiser | 271/273 X |
| 4,369,961 | 1/1983 | Gopel et al. | 271/35 X |
| 5,253,861 | 10/1993 | Schmaling | 271/273 X |

*Primary Examiner*—Boris Milef
*Attorney, Agent, or Firm*—Jenkins & Wilson, P.A.

[57] ABSTRACT

A collector apparatus and method are provided for collecting sheet articles and advancing collected sheet articles therefrom. The collector apparatus includes a collector plate having a surface for receiving one or more sheet articles thereon to collect the sheet articles. At least one stop bracket is movable through an opening defined through the collector plate to provide a stop for collected sheet articles and to allow collected sheet articles to be further advanced from their collection position. At least one upper idler drop roller is spacedly positioned above and movable toward the collector plate surface. At least one transport mechanism is positioned below the collector plate surface and includes at least a portion thereof which is adapted for movement through the opening of the collector plate toward the upper idler drop roller such that the upper idler drop roller and the portion of the transport belt can pinch together collected sheet articles for the transport belt to advance the sheet articles from their collected position. A lower roller assembly is preferably utilized to force the transport belt through the opening of the collector plate. In the method provided, movement of the upper idler drop roller toward the collector plate surface, the stop bracket away from its stop position and the lower roller assembly through the opening of the collector plate occur simultaneously.

21 Claims, 11 Drawing Sheets

NON-MARKING COLLECTOR APPARATUS AND METHOD

TECHNICAL FIELD

The present invention relates generally to a collector apparatus and method for collecting and advancing sheet articles. More particularly, the present invention relates to a collector apparatus and method, particularly for use in high-speed media processing, for collecting and advancing sheet articles wherein the sheet articles have minimal contact with the transport mechanism utilized to advance the sheet articles from the collector apparatus.

BACKGROUND ART

Various types of collector apparatuses have been utilized for collecting sheet articles thereon and subsequently advancing the collected sheet articles from their collected position. The sheet articles can typically be individual, single panel sheets and/or folded sheet articles each consisting of a plurality of panels. One prior art collector apparatus which has commonly been used in high-speed media processing has been utilized adjacent to the main system raceway to hold accumulated folded or unfolded sheet articles prior to advancing them to the raceway. Such a collector apparatus includes a collector plate surface with a pair of parallel and spaced-apart continuously running transport belts. The transport belts in conjunction with the collector plate surface provide support for sheet articles advanced to and collected on the collector apparatus.

Collected sheet articles are typically advanced along the collector plate surface by continuous contact with the transport belts or other means by which they are advanced therealong until they reach a collection position where further advancement is prevented by contact of the sheet articles with a pair of stop brackets positioned perpendicular to the collector plate surface. Each stop bracket extends through an opening defined through the collector plate surface as the stop brackets are movable between a stop position where they can stop or prevent further advancement of the sheet articles along the collector plate surface and an advance position where the stop brackets are below the collector plate surface and therefore allow advancement or passage of the sheet articles past their collection position.

A pair of upper idler drop rollers are positioned above the collector plate surface and are solenoid-actuated by a single solenoid to move down onto sheet articles collected on the collector plate surface so that the upper idler drop rollers can move downwardly toward the collector plate surface to force the collected sheet articles against the transport belts to facilitate advancement of the sheet articles on the collector plate surface. As the upper idler drop rollers move downwardly toward the collector plate surface, the stop brackets simultaneously move downwardly below the collector plate surface and out of the way of sheet articles to be advanced from their collection position. Single or stacked sheet articles can be collected on the collector plate surface and advanced therefrom, and the sheet articles can be accumulated flat or folded material on the collector plate surface.

A problem which has been found to be associated with such a collector apparatus and which will be apparent to those of skill in the art of high-speed media processing is that the sheet articles collected on the collector plate surface are in continuous contact to some degree with the continuously moving transport belts as the collected sheet articles are maintained in their collection position and prevented from further advancement by the stop brackets. Such contact is quite disadvantageous since the sheet articles often have toner thereon which, on occasion, is caused to smear on the collected sheet articles because of the contact of the sheet articles with the continuously running transport belts. The actual time in which collected sheet articles are prevented from further advancement by the stop brackets can vary with different placements and purposes of the collector apparatus, although in high-speed media processing, even very short amounts of time can be critical. Another problem associated with such a collector apparatus is the limited capacity of the collector apparatus regarding its ability to transport or advance large stacks of collected sheet articles therefrom. Such a collector apparatus has a limited capacity or ability of only being able to advance or transport a stack of up to twenty-one (21) sheet articles therefrom.

In view of the problems associated with prior art collector apparatuses and methods, it can therefore be seen that much room for improvement exists in the art of collector apparatuses and methods for use in high-speed media processing for collecting and advancing sheet articles. Particular room for improvement exists for a collector apparatus and method providing minimal contact of collected sheet articles with moving transport belts used to advance the sheet articles from the collector apparatus as well as a collector apparatus and method with increased ability to advance collected sheet articles from their collected position and from the collector apparatus.

DISCLOSURE OF THE INVENTION

In accordance with the present invention, a modular collector apparatus and method are provided for collecting sheet articles and subsequently advancing the collected sheet articles. The collector apparatus comprises a surface for receiving one or more sheet articles thereon to collect the sheet articles in a collection position, and the collector plate surface defines one or more openings therethrough. One or more stop brackets are receivable through an area of the openings of the collector plate surface and are movable between a stop position where the stop brackets provide a stop preventing advancement of collected sheet articles past their collected position and an advance position where the stop brackets allow advancement of collected sheet articles past their collected position. One or more solenoid-actuated upper idler drop rollers are spacedly positioned above the collector plate surface and are movable toward the collector plate surface such that the upper idler drop rollers can engage previously collected sheet articles. One or more transport belts are positioned below the collector plate surface such that the transport belts do not contact the collected sheet articles while the sheet articles are maintained in their collected position on the collector plate surface with further advancement being prevented by the stop brackets.

The collector apparatus includes means for forcing at least a portion of the transport belts through the openings of the collector plate surface to engage collected sheet articles. In the preferred embodiment, the means for forcing a portion of the transport belts through the openings of the collector plate surface comprises a solenoid-actuated lower roller assembly which includes one or more lower rollers adapted for forcing a portion of the transport belts upwardly through the openings of the collector plate.

The upper idler drop rollers and the stop brackets are preferably operatively connected by operative connection or attachment of each to a common shaft. In this manner, movement of the upper idler drop rollers towards the collector plate surface occurs simultaneously with movement of the stop brackets away from their stop position to thereby allow further advancement of collected sheet articles from their collected position. As the upper idler drop rollers and the stop brackets move, the rollers of the lower roller assembly also move to cause the portions of the transport belts to extend through the openings of the collector plate surface and engage collected sheet articles. The upper idler drop rollers move toward the portions of the transport belts to engage collected sheet articles from an opposite direction of the portions of the transport belts. The upper idler drop rollers and the portions of the transport belts pinch together collected sheet articles positioned therebetween for the portions of the transport belts to advance the collected sheet articles from their collected position.

It is therefore an object of the present invention to provide a novel collector apparatus and method, particularly for use in high-speed media processing, for collecting and advancing sheet articles.

It is another object of the present invention to provide a collector apparatus and method for collecting and advancing sheet articles wherein collected sheet articles have minimal contact with the transport mechanism utilized to advance the collect sheet articles from their collected position.

It is a further object of the present invention to provide a collector apparatus and method which is modular and provides enhanced or increased ability to advance collected sheet articles from the collector apparatus.

Some of the objects of the invention having been stated hereinabove, other objects will become evident as the description proceeds, when taken in connection with the accompanying drawings as best described hereinbelow.

BEST MODE FOR CARRYING OUT THE INVENTION

In accordance with the present invention, a novel collector apparatus generally designated 10 and method are provided which have particular use in high-speed media processing for collecting one or more sheet articles and advancing them to another location such as the main system raceway. The sheet articles can be unfolded sheet articles or folded sheet articles each having a plurality of panels as will be apparent to those of skill in the art. Collector apparatus 10 is particularly adapted for collecting and advancing one or more stacked or unstacked sheet articles in high-speed media processing in a single row or "one-up" relationship in the preferred embodiment. It can be appreciated in accordance with this invention, however, that collector apparatus 10 could be adapted for collecting and advancing sheet articles in other relationships, such as, for example, a "two-up" relationship. In the preferred embodiment, collector apparatus 10 is modular in design and can be operatively attached or connected in-line with a variety of suitable sheet article processing devices such as, for example, a variety of folder devices or even a variety of cutter devices.

Referring generally to the various figures of drawings, collector apparatus 10 is illustrated and comprises collector plate 12 which has a top collector plate surface 14 which is adapted to receive and support sheet articles thereon. Collector plate 12 and collector plate surface 14 can be constructed of any material suitable for use with collector apparatus 10 such as sheet metal. In the preferred embodiment, collector plate 12 defines a pair of spaced-apart openings 16A and 16B which are parallel to one another and extend in the direction in which sheet articles are advanced to and along collector plate surface 14.

Figure 1:
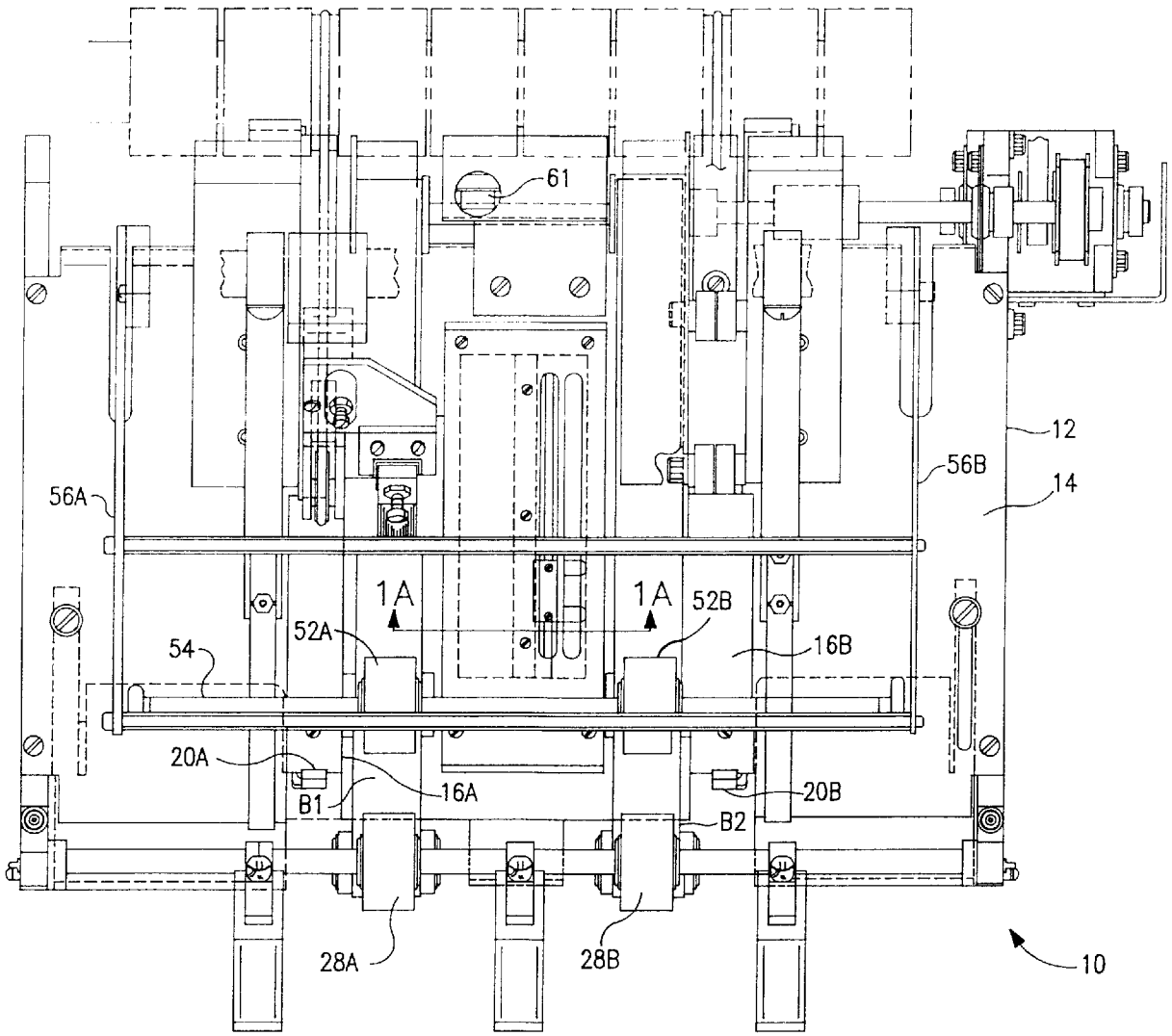
FIG. 1 of the drawings is a top plan view of one embodiment of a collector apparatus according to the present invention.

One or more sheet articles, either folded or unfolded, can be advanced to collector plate surface 14 and accumulated thereon in a stacked collection position where further advancement along collector plate surface 14 is prevented by a pair of stop brackets 20A and 20B. In their stop position as shown in FIG. 1, ends of stop brackets 20A and 20B extend upwardly through a portion of openings 16A and 16B, respectively, and are at least substantially perpendicular to collector plate surface 14 to provide a stop preventing further advancement of collected sheet articles from their collection position. It is envisioned according to this invention that stop brackets 20A and 20B could extend through openings of collector plate surface 14 which are separate and distinct from openings 16A and 16B. Stop brackets 20A and 20B are movable from their stop position to an advance position where they are moved away from collector plate surface 14 by preferably being moved below collector plate surface 14 in order to move out of the way of and allow further advancement of collected sheet articles from their collected position. It is preferred that stop brackets 20A and 20B be operatively connected by attachment to a common shaft 26 such that rotational movement of shaft 26 causes simultaneous and identical movement of both stop brackets 20A and 20B.

Still referring generally to the various figures of drawings, collector apparatus 10 further comprises transport means preferably in the form of transport belts B1 and B2 which are positioned below collector plate surface 14 and adapted for continuous movement during operation of collector apparatus 10. Transport belts B1 and B2 remain below collector plate surface 14 while collected sheet articles are maintained in their collection position and prevented from further advancement by stop brackets 20A and 20B. When stop brackets 20A and 20B move to their advance positions, however, at least a portion of each transport belt B1 and B2 is forcibly moved upwardly through openings 16A and 16B, respectively, of collector plate surface 14 to engage collected sheet articles in their collection position as further described hereinbelow. Also as described further hereinbelow, a lower roller assembly generally designated 30 and best illustrated in FIGS. 3, 3A, 3B and 3C of the drawings is utilized to forcibly move a portion of each transport belt B1 and B2 upwardly through openings 16A and 16B, respectively, to engage collected sheet articles. Transport belts B1 and B2 are thereby utilized to advance collected sheet articles past their collection position.

To facilitate such advancement, collector apparatus 10 comprises an upper roller system generally designated 50 (FIG. 2E) which includes a pair of upper idler drop rollers 52A and 52B which are positioned above collector plate surface 14 and are solenoid-actuated to move toward collector plate surface 14 and toward transport belts B1 and B2. Upper idler drop rollers 52A and 52B are adapted for movement toward the portion of both transport belts B1 and B2, respectively, that is forced upwardly through openings 16A and 16B, respectively, of collector plate 12. Upper idler drop rollers 52A and 52B are adapted to engage collected sheet articles from an opposite direction of that of transport belts B1 and B2, and upper idler drop rollers 52A and 52B and the portion of each transport belt B1 and B2, respectively, that passes through openings 16A and 16B, respectively, pinch together collected sheet articles for transport belts B1 and B2 to further advance collected sheet articles, as discussed further hereinbelow.

Figure 1A:
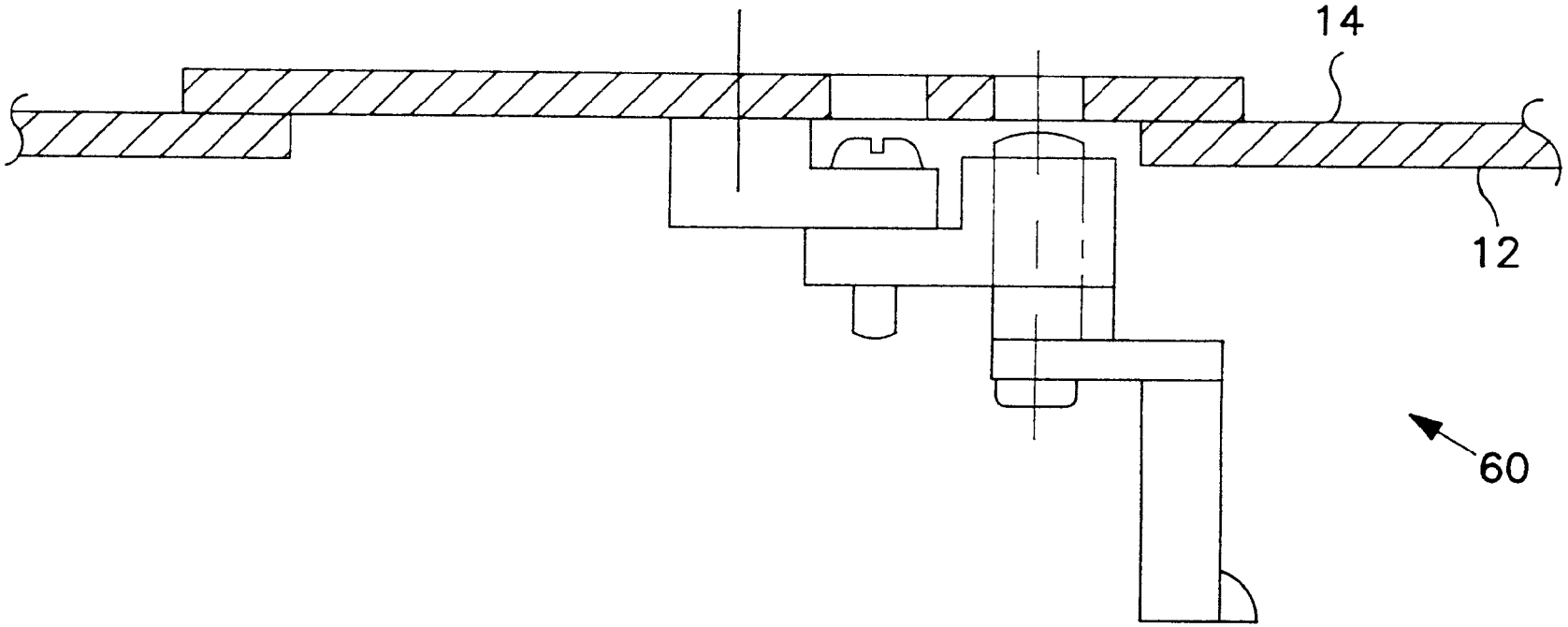
FIG. 1A of the drawings is a sectional view drawn along line 1A—1A of FIG. 1 illustrating a sensor utilized with the collector apparatus.

Referring now specifically to FIG. 1 of the drawings, a top plan view of collector apparatus 10 is provided. Collector plate 12 with top collector plate surface 14 and spaced-apart openings 16A and 16B are illustrated. Belts B1 and B2 can be seen through openings 16A and 16B. The ends of stop brackets 20A and 20B are also illustrated as they are in their stop position where they can prevent advancement of collected sheet articles past stop brackets 20A and 20B. Upper idler drop rollers 52A and 52B are also illustrated in FIG. 1 as each is connected to common shaft 54 which is supported by arms 56A and 56B which attach at an opposite end thereof to shaft 26. Exit rollers 28A and 28B can also be seen in FIG. 1 and are preferably movably vertically biased against belts B1 and B2, respectively, so as to allow and guide sheet articles to be advanced therebetween and exit collector apparatus 10. FIG. 1A of the drawings illustrates a sensor generally designated 60 which, as will be apparent to those of skill in the art, can be an infrared detector which can be used with collector apparatus 10 to detect material presence. A count cell sensor 61 (FIGS. 1 and 2E) is provided for verifying actual entry of sheet articles into collector apparatus 10.

Referring to FIGS. 2, 2A, 2B, 2C, 2D, and 2E of the drawings, a top plan view and various sectional views of collector apparatus 10 with collector plate 12 and the portion of upper roller assembly 50 described thus far removed therefrom is provided. Belts B1 and B2 and stop brackets 20A and 20B are better illustrated, and it can be seen that belts B1 and B2 extend and are adapted to roll around rollers 62A, 62B and 64A, 64B, respectively. Belts B1 and B2 can be operatively connected such as by having a common drive source so as to be operable simultaneously at identical speeds. Stop brackets 20A and 20B each are elongated and include ends 22A and 22B, respectively, attached to shaft 26, and an opposite, upwardly perpendicular end which is utilized to provide a stop for collected sheet articles in the stop position.

A pair of spaced-apart solenoids 58A and 58B are attached to collector apparatus 10 and can be utilized to actuate the downward movement of upper idler drop rollers 52A and 52B toward collector plate surface 14 to engage collected sheet articles and downward movement of stop brackets 20A and 20B by forced rotation of shaft 26. Solenoids 58A and 58B can be operatively connected to shaft 26 by one or more linking arms such as linking arms L1, L2 and 56A shown best in FIG. 2B where linking arm 56A can be attached to shaft 26. The use and strategic positioning of solenoids 58A and 58B advantageously provides torsional balance and increased force for upper idler drop rollers 52A and 52B, and therefore increased ability of collector apparatus 10 to advance collected sheet articles therefrom. It has been found in accordance with this invention that collector apparatus 10 can collect and advance a stack of up to approximately fifty (50) single sheet articles of the type typically used in high-speed media processing.

A spring 66 (FIG. 2) is operatively and biasedly connected to shaft 26 and can be used to cause shaft 26 to return to its original or ready position after shaft 26 has been caused to rotate by solenoids 58A and 58B. An air cylinder 68 is also illustrated and can be used to act as a shock absorber to prevent the system from bouncing. Also illustrated in FIGS. 2, 2A, 2B, 2C, 2D and 2E are portions of lower roller assembly 30 which are described hereinbelow.

Figure 2:
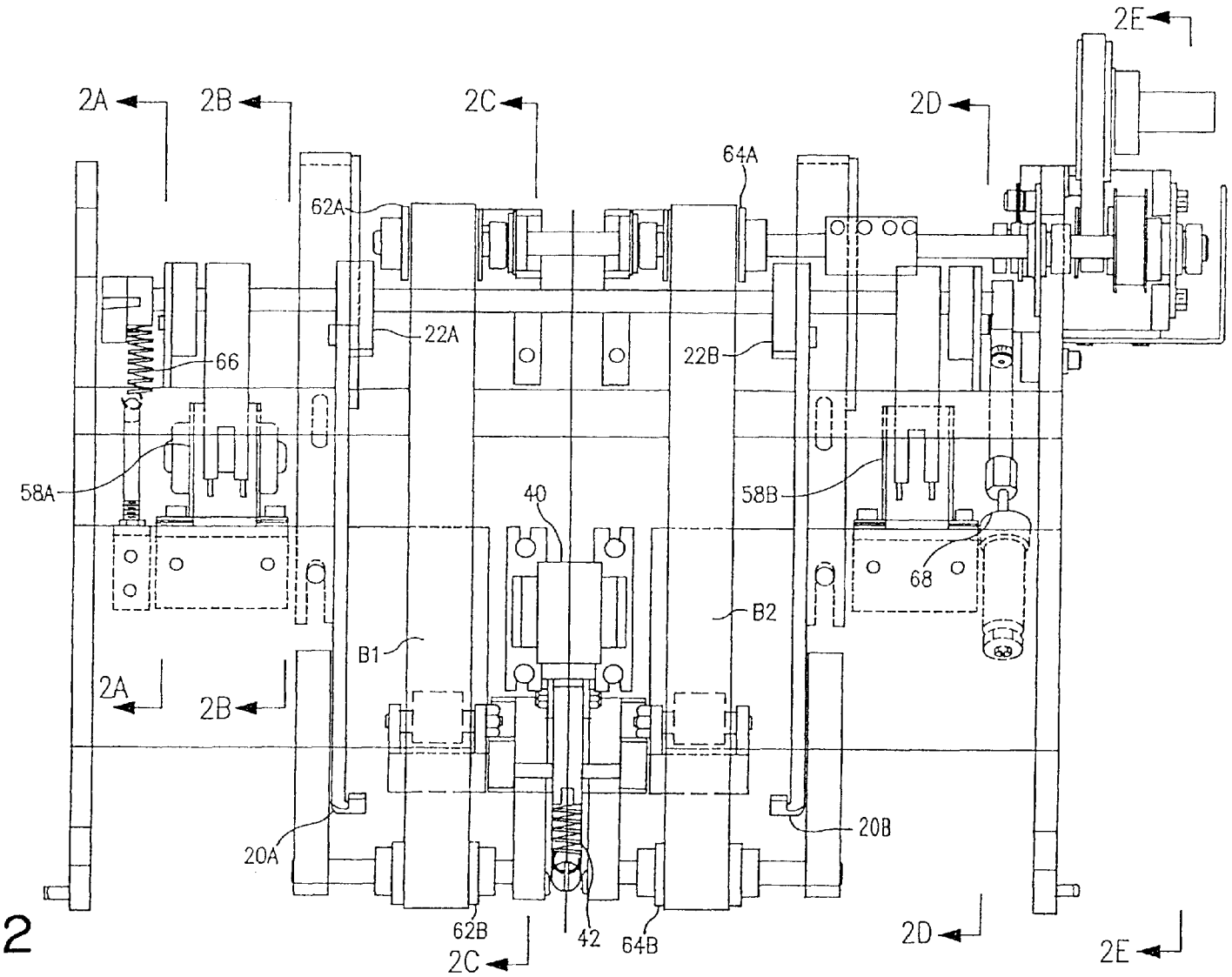
FIG. 2 of the drawings is a top plan view of the collector apparatus of FIG. 1 with the collector plate and a portion of the upper roller assembly of the present invention removed.
Figure 2A:
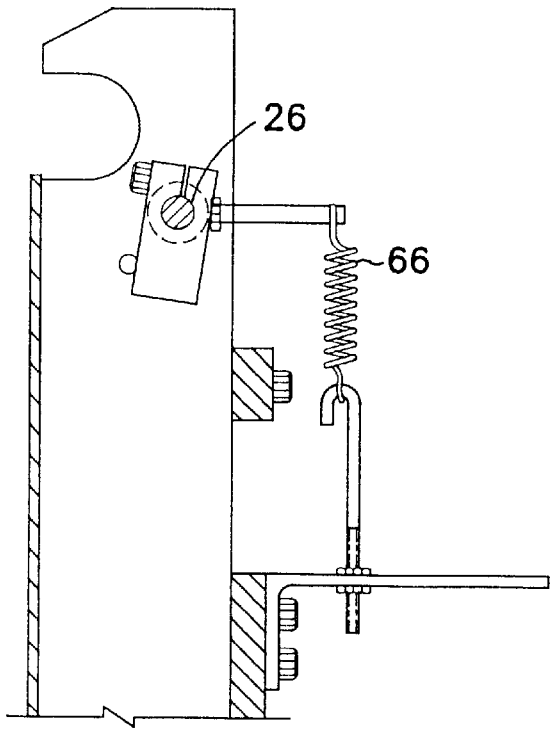
FIG. 2A of the drawings is a sectional view drawn along line 2A—2A of the collector apparatus of FIG. 2.
Figure 2B:
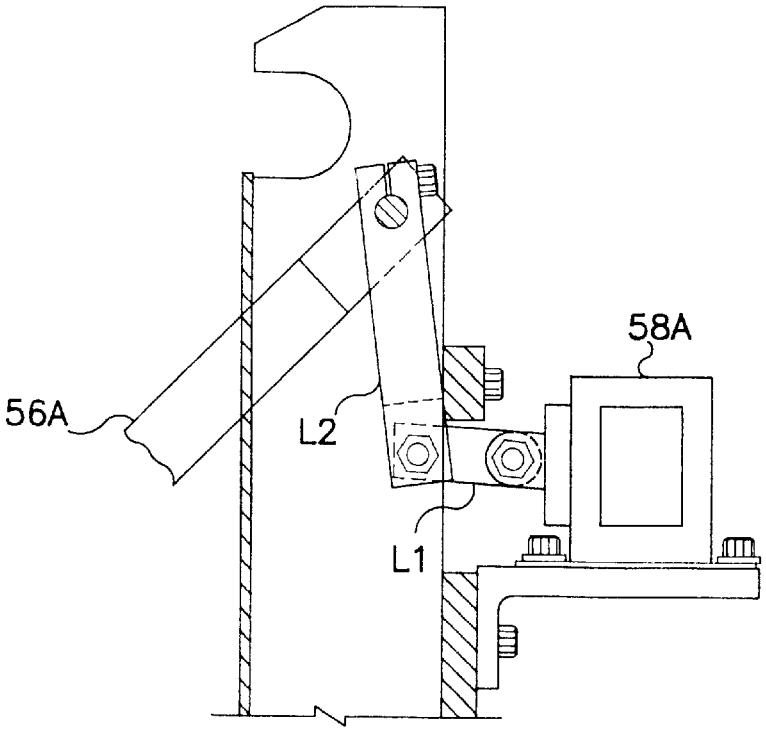
FIG. 2B of the drawings is a sectional view drawn along line 2B—2B of the collector apparatus of FIG. 2.
Figure 2C:
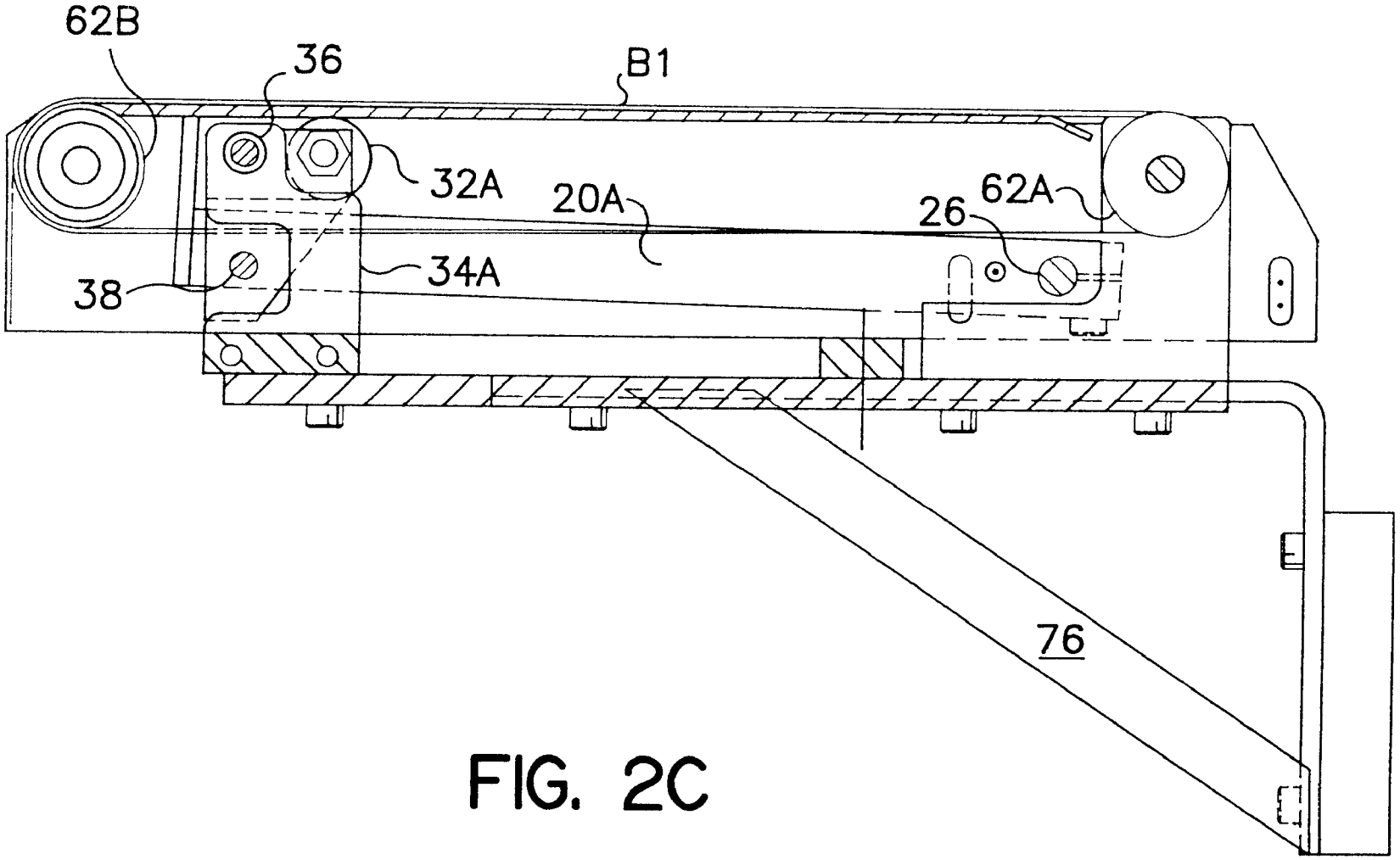
FIG. 2C of the drawings is a sectional view drawn along line 2C—2C of the collector apparatus of FIG. 2.
Figure 2D:
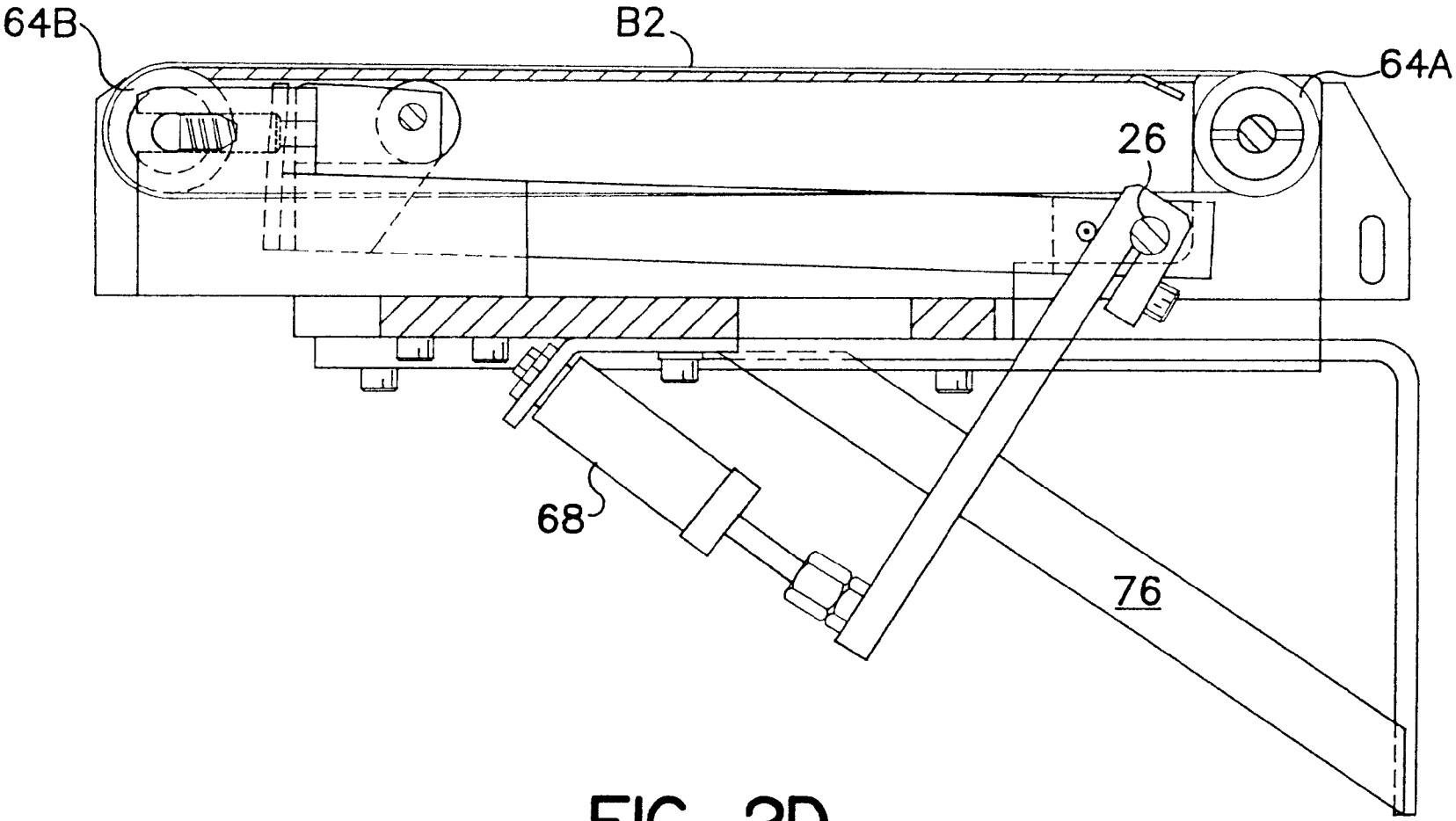
FIG. 2D of the drawings is a sectional view drawn along line 2D—2D of the collector apparatus of FIG. 2.
Figure 2E:
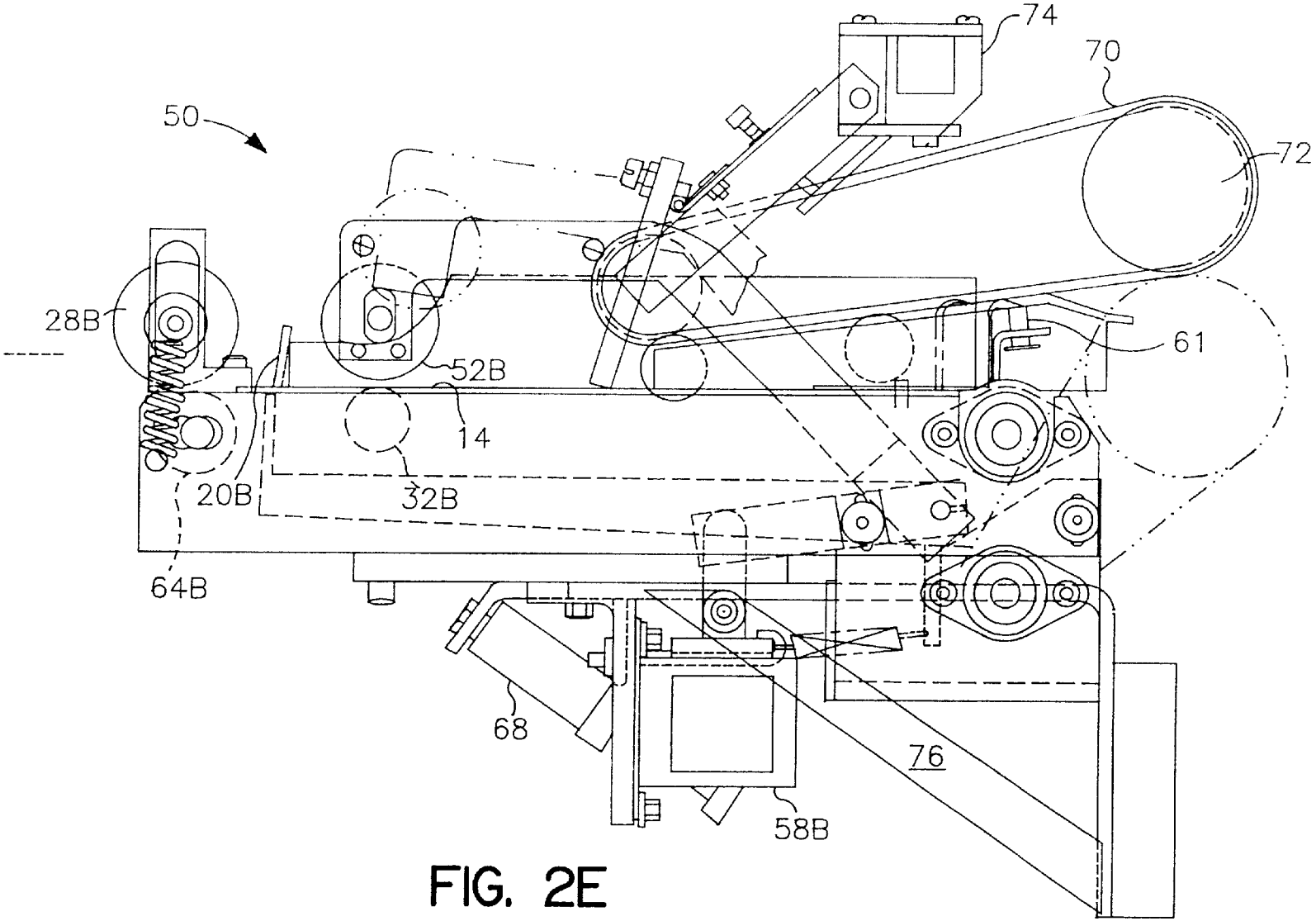
FIG. 2E of the drawings is a side view from along line 2E—2E of the collector apparatus of FIG. 2 including schematic illustration of the upper roller assembly and a drive mechanism used to advance sheet articles to the collector plate of the present invention.

FIG. 2E provides a side view of collector apparatus 10 from along line 2E—2E of FIG. 2 and includes schematic illustrations of upper roller system 50 and a drive system for advancing sheet articles to collector apparatus 10 added thereto. Arm 56B of upper roller system 50 is shown in both an original or ready upper position and in an operative lowered position where it has moved upper idler drop roller 52B toward collector plate surface 14 and lower idler roller 32B. Two positions of stop bracket 20B are partially shown as stop bracket 20B is illustrated in both its actuated lowered position where it is below collector plate surface 14 and partially illustrated in its original higher position where it extends above and at least substantially perpendicular to collector plate surface 14. FIG. 2E also illustrates an example of a drive system for advancing sheet articles to collector plate surface 14 as polycord belt 70 can extend and operate between collector apparatus 10 and another machine with which collector apparatus 10 can be in-line with or attached to, such as, for example, a folding machine. Another polycord belt (not shown in FIG. 2E) can be positioned in a parallel relationship to belt 70 and used as a part of the drive system for advancing sheet articles to collector apparatus 10. Drive shaft or roller 72 can be part of a machine with which collector apparatus 10 can be operatively connected and can act as an upper guide and transport means for sheet articles leaving the prior in-line machine and advancing to collector apparatus 10. Attachment piece 74 of collector apparatus 10 can be used to attach the upper components of collector apparatus 10 directly to a prior in-line machine such as a folding machine. Support 76 (FIGS. 2C, 2D and 2E) provides lower support for collector apparatus 10 and can also be used to attach collector apparatus 10 to a prior in-line machine.

Figure 3:
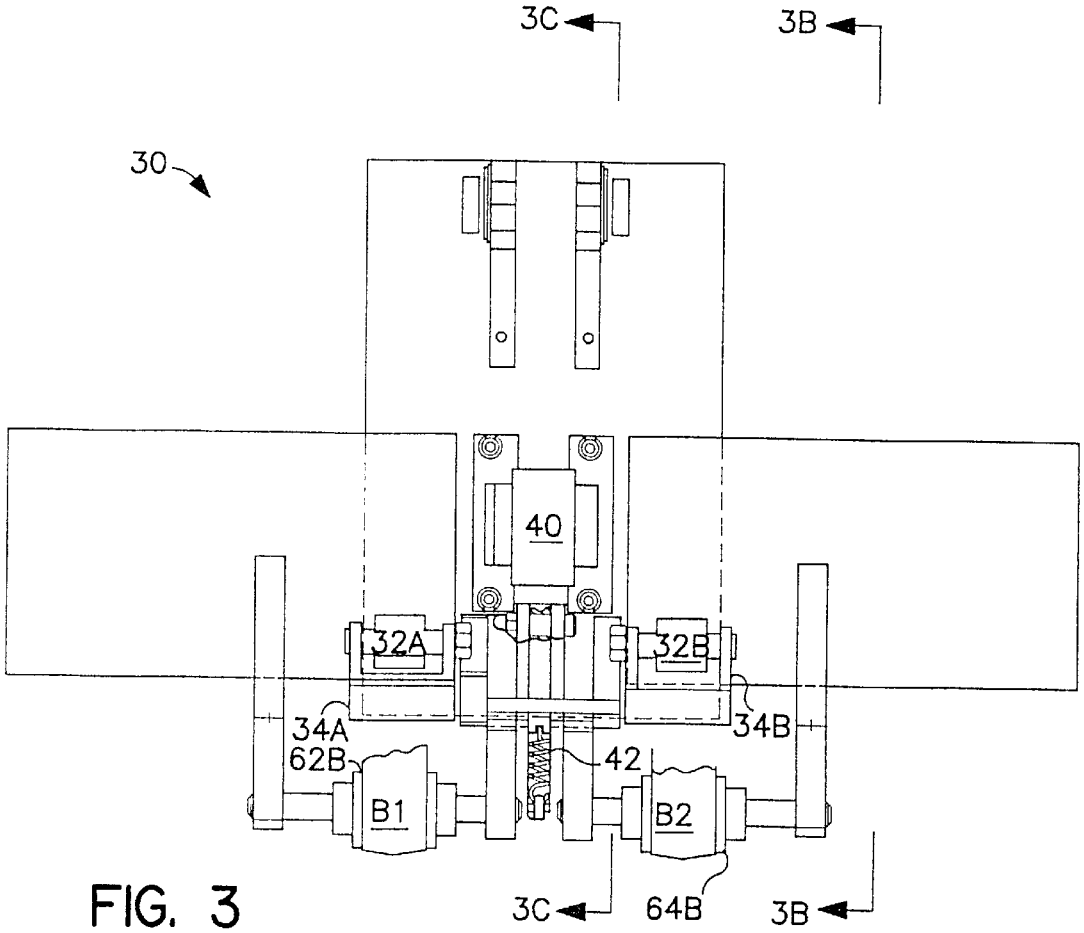
FIG. 3 of the drawings is an isolated top plan view of the lower roller assembly of the collector apparatus illustrated in FIG. 1.
Figure 3A:
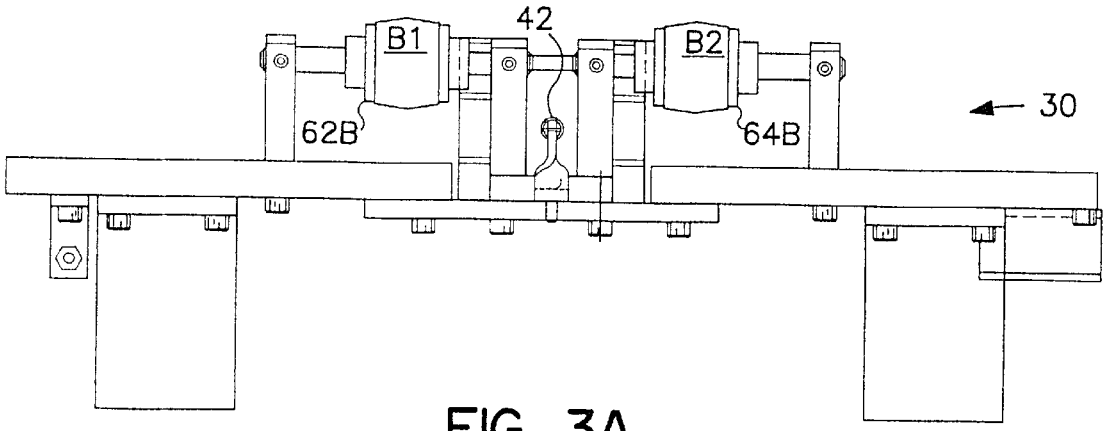
FIG. 3A of the drawings is a front elevation view of the lower roller assembly of FIG. 3.
Figure 3B:
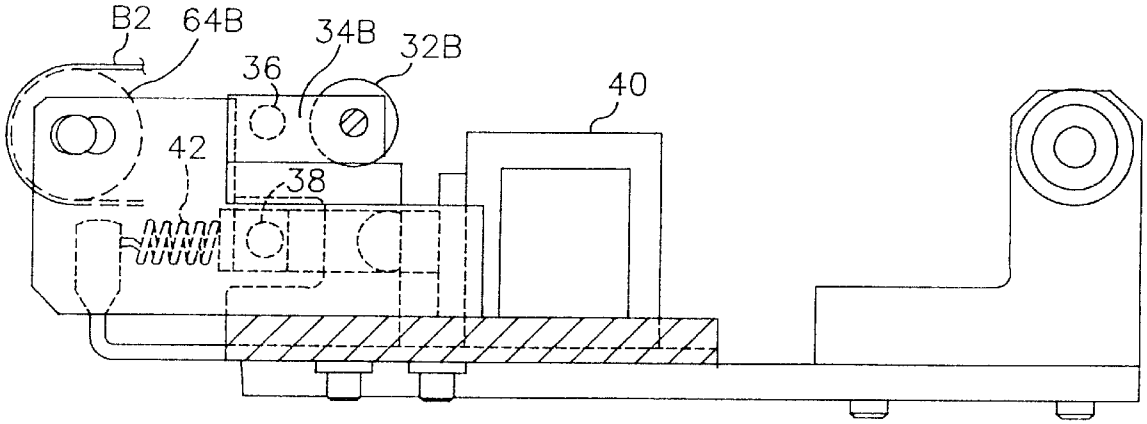
FIG. 3B of the drawings is a sectional view drawn along line 3B—3B of the lower roller assembly of FIG. 3.
Figure 3C:
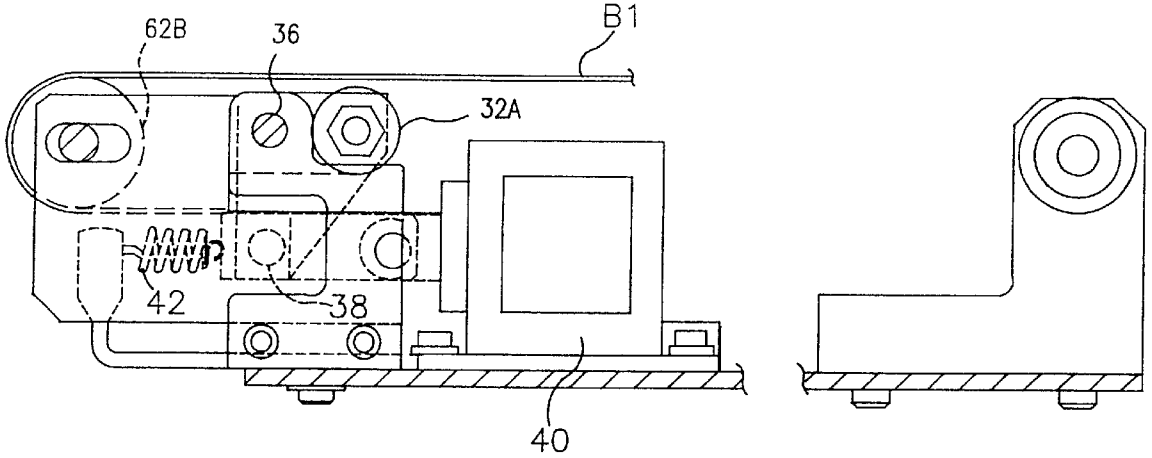
FIG. 3C of the drawings is a sectional view drawn along line 3C—3C of the lower roller assembly of FIG. 3.

FIG. 3 of the drawings provides an isolated, top plan view of lower roller assembly 30. FIG. 3A of the drawings illustrates a front elevation view of lower roller assembly 30 of collector apparatus 10, and FIGS. 3B and 3C of the drawings provide various sectional views of lower roller assembly 30. Lower roller assembly 30 includes a pair of rotatably movable lower idler rollers 32A and 32B which are attached to support members 34A and 34B, respectively. Lower idler rollers 32A and 32B and support members 34A and 34B are positioned below and adjacent to the top or upper level of transport belts B1 and B2, respectively, such that lower idler rollers 32A and 32B can forcibly move portions of the upper level of transport belts B1 and B2, respectively, to extend through openings 16A and 16B, respectively, of collector plate 12. For movement of lower idler rollers 32A and 32B in this manner, support members 34A and 34B are pivotally movable about pivot shaft 36, which is best illustrated in FIGS. 3B and 3C, to cause lower idler rollers 32A and 32B to move upwardly. Support members 34A and 34B are operatively connected by a connecting shaft such as connecting shaft 38. Lower roller system 30 further includes a solenoid 40 which is operatively connected to connecting shaft 38 and can therefore be utilized to actuate support members 34A and 34B by pulling shaft 38 back and causing support members 34A and 34B and lower idler rollers 32A and 32B to pivot about pivot shaft 36 . In this manner, lower idler rollers 32A and 32B can be used to forcibly move belts B1 and B2, respectively, upwardly through openings 16A and 16B, respectively. A spring 42 is preferably biasedly connected to shaft 38 and can be utilized to pull shaft 38, and therefore lower idler rollers 32A and 32B, back to the original or ready position after solenoid 40 has caused lower idler rollers 32A and 32B to move upwardly belts B1 and B2, respectively. According to the preferred embodiment of this invention, the same software signal can be used to activate solenoids 40, 58A and 58B. Movement of upper roller system 50, lower roller system 30 and stop brackets 20A and 20B can therefore be initiated and occur simultaneously.

Figure 4A:
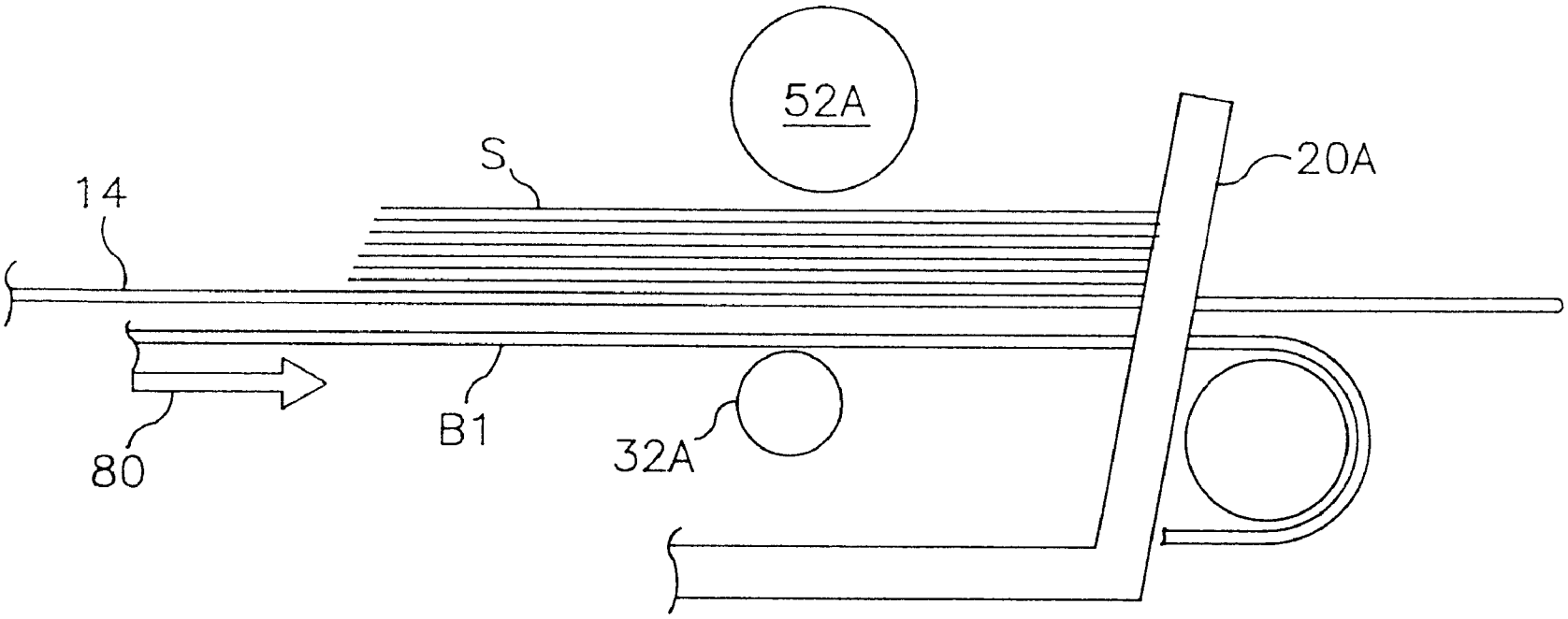
FIG. 4A of the drawings is a schematic illustration of sheet articles collected on a collector apparatus according to the present invention.
Figure 4B:
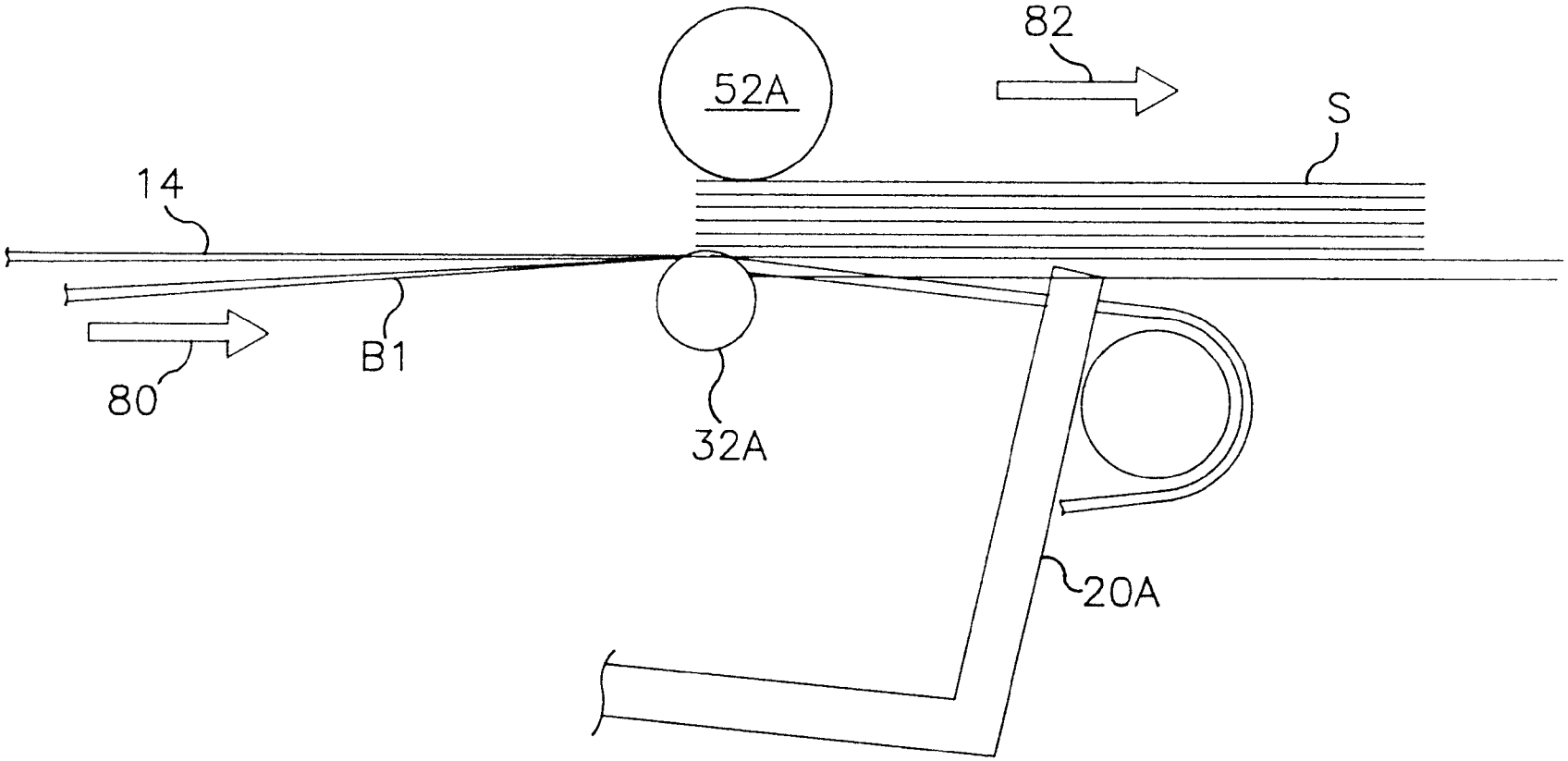
FIG. 4B of the drawings is a schematic illustration illustrating the sheet articles of FIG. 4 in an advanced position on a collector apparatus according to the present invention.

FIGS. 4A and 4B of the drawings are schematic illustrations of collector apparatus 10 and the method of the present invention. As illustrated in FIG. 4A, sheet articles S have been advanced on collector plate surface 14 to the collection position where further advancement is prevented by stop bracket 20A. At this point, transport belt B1 is entirely positioned below collector plate surface 14 as is lower idler roller 32A. Although transport belt B1 can be run selectively, it preferably runs continuously in the direction of arrow 80. Upper idler drop roller 52A is positioned above and spaced-apart from collector plate surface 14 and collected sheet article S. Collected sheet articles S can be maintained in such collected position on collector apparatus 10 until it is desirable to further advance collected sheet articles S from their collection position.

FIG. 4B of the drawings illustrates collected sheet articles S being advanced from their collection position. As illustrated, stop bracket 20A has moved downwardly below collector plate surface 14 to move out of the way of sheet articles S and to allow sheet articles S to be further advanced from their collection position. A portion of transport belt B1 has been forcibly moved upwardly by lower idler roller 32A barely above collector plate surface 14 to engage at least one of sheet articles S, and upper idler drop roller 52A has moved downwardly to engage at least one of sheet articles S such that upper idler drop roller 52A and the portion of transport belt B1 above collector plate surface 14 pinch together sheet articles S for transport belt B1 to cause sheet articles S to advance from their collection position in the direction of arrow 82. Lower idler roller 32A preferably causes a portion of transport belt B1 to move at least approximately 1/16th of an inch above collector plate surface 14. Once sheet articles S are advanced from between upper idler drop roller 52A and the portion of transport belt B1 above collector plate surface 14 and past the lower stop bracket 20A, each of the movable components of collector apparatus 10 then return to its original position as shown in FIG. 4A for receiving and collecting additional sheet articles. Transport belt B1 therefore advantageously is not in constant contact with collected sheet articles S in FIG. 4A while collected sheet articles S are in their collection position, and transport belt B1 only contacts at least one of sheet articles S when sheet articles S are advanced from their collection position.

It is therefore seen that the present invention provides a novel collector apparatus and method, particularly for use in high-speed media processing, for collecting and advancing sheet articles. It is also seen that the present invention provides a collector apparatus and method for collecting and advancing sheet articles wherein collected sheet articles have minimal contact with the transport mechanism used to advance the collected sheet articles. It can further be appreciated that the collector apparatus and method of the present invention include an enhanced or increased ability to advance collected sheet articles from their collection position and from the collector apparatus.

It will be understood that various details of the invention may be changed without departing from the scope of the invention. Furthermore, the foregoing description is for the purpose of illustration only, and not for the purpose of limitation as the invention is defined by the following, appended claims.

What is claimed is:

1. A collector apparatus for collecting sheet articles in a collected position and advancing collected sheet articles from the collected position, said collector apparatus comprising:

(a) a collector plate having a surface for receiving one or more sheet articles thereon to collect the sheet articles in a collected position in a horizontal plane, said collector plate surface defining at least one opening therethrough;

(b) at least one stop bracket movable through said opening of said collector late surface to provide a stop for sheet articles collected in the collected position on said collector plate surface and movable away form said collector plate surface to allow collected sheet articles to be advanced past the collected position;

(c) at least one upper idler roller spacedly positioned above said collector plate surface and being moveable toward said collector plate surface and collected sheet articles in the collected position;

(d) at least one transport belt positioned below said collector plate surface and having at least a portion thereof which is moveable through said opening of said collector plate toward said upper idler roller and collected sheet articles in the collected position; and (e) means for forcing said portion of said transport belt through said opening of said collector plate surface toward said upper idler roller whereby said portion of said transport belt and said upper idler roller can simultaneously engage one or more sheet articles therebetween, while said sheet articles are in said collected position in said horizontal plane, such that said portion of said transport belt can advance the sheet articles from said collector apparatus.

2. The collector apparatus of claim 1 wherein said means for forcing said portion of said transport belt comprises at least one lower idler roller.

3. The collector apparatus of claim 2 wherein said lower idler roller is solenoid-activated.

4. The collector apparatus of claim 1 wherein said at least one upper idler roller is solenoid-activated.

5. The collector apparatus of claim 1 wherein said transport belt is adapted for continuous movement.

6. The collector apparatus of claim 1 wherein said stop bracket and said upper idler roller are interconnected such that movement of said upper idler roller toward said collector plate surface causes simultaneous movement of said stop bracket away from said collector plate surface.

7. The collector apparatus of claim 6 wherein said stop bracket and said upper idler roller are attached to a common shaft and movement of said upper idler roller toward said collector plate surface causes movement of said stop bracket below said collector plate surface.

8. The collector apparatus of claim 1 wherein a pair of substantially parallel transport belts are positioned below said collector plate surface and said collector plate surface defines a pair of spaced-apart openings therethrough each for passage of a portion of one of said pair of transport belts therethrough.

9. The collector apparatus of claim 8 comprising a pair of solenoid-actuated upper idler rollers.

10. A collector apparatus for collecting sheet articles and subsequently advancing collected sheet articles therefrom, said collector apparatus comprising:

(a) a collector plate having a surface for receiving and supporting one or more sheet articles advanced thereto to collect said sheet articles in a collected position in a horizontal plane, said collector plate surface defining a pair of spaced-apart openings therethrough;

(b) a pair of operatively connected stop brackets moveable between a stop position wherein said stop brackets extend through said openings of said collector plate surface and provide a stop preventing further advancement of collected sheet articles past their collected position, and an advance position wherein said stop brackets allow further advancement of collected sheet articles past their collected position;

(c) a pair of upper idler rollers spacedly positioned above said collector plate surface, said upper idler rollers being operatively connected to said stop brackets such that movement of said upper idler rollers toward said collector plate surface causes simultaneous movement of said stop brackets away from said collector plate surface allowing collected sheet articles to be advanced past said stop brackets;

(d) a pair of transport belts adapted for continuous movement and positioned below said collector plate surface such that a portion of each transport belt is moveable through a different one of said pair of openings defined by said collector plate surface toward a different one of said pair of upper idler rollers; and (e) means for forcing said portion of each of said transport belts through a different one of said openings defined through said collector plate surface toward a different one of said upper idler rollers whereby said portions of said transport belts and said upper rollers can simultaneously engage and pinch together one or more sheet articles therebetween, in the horizontal plane, whereby said portions of each of said transport belts can further advance said sheet articles from their collected position and past said stop brackets.

11. In a collector apparatus comprising a collector plate having a surface for receiving and supporting one or more sheet articles advanced thereto and collected thereon in a horizontal plane, one or more stop brackets moveable between a stop position to provide stops for sheet articles advanced to and collected on the collector plate surface and an advance position to allow collected sheet articles to be advanced past the stop brackets, one or more transport belts for transporting collected sheet articles, and one or more upper idler rollers positioned above and adapted to move downwardly towards the collector plate surface, the improvement comprising:

(a) said one or more transport belts being positioned horizontally below said collector plate surface and said collector plate surface defining one or more openings therethrough such that at least a portion of said one or more transport belts can extend through said one or more openings toward said one or more upper idler rollers whereby said portion of said one or more transport belts and said one or more upper idler rollers can simultaneously engage collected sheet articles positioned in the horizontal plane therebetween such that said portion of said one or more transport belts can advance collected sheet articles past said one or more brackets when said one or more stop brackets are in the advance position; and (b) means for forcing said portion of said one or more transport belts through said one or more openings defined by said collector plate surface toward said one or more upper idler rollers;

(c) whereby said one or more transport belts have minimal contact with sheet articles collected on and advanced from the collector apparatus.

12. The combination of claim 11 wherein said means for forcing said portion of said one or more transport belts comprises one or more moveable lower idler rollers adapted for engaging and forcing said portion of said one or more transport belts through said one or more openings of said collector plate surface.

13. The combination of claim 12 further comprising means for causing simultaneous movement of said one or more lower idler rollers toward said one or more upper idler rollers and said one or more upper idler rollers toward said collector plate surface.

14. A method of collecting one or more sheet articles and subsequently advancing said one or more collected sheet articles, said method comprising the steps of:

(a) advancing one or more sheet articles to a surface of a collector apparatus to collect said one or more sheet articles in a collected position in a horizontal plane thereon where further advancement of said one or more sheet articles is stopped by one or more stop brackets;

(b) moving at least a portion of one or more transport belts positioned on one side of said collector plate surface through one or more openings defined through said collector plate surface to engage at least one of said one or more collected sheet articles in the collected position;

(c) moving one or more rollers positioned on an opposite side of said collector plate surface from said one or more transport belts toward said collector plate surface to engage at least one of said one or more sheet articles in the collected position in the horizontal plane between said one or more rollers and said portion of said one or more transport belts;

(d) moving said one or more stop brackets to allow advancement of said one or more collected sheet articles from the collected position further along said collector plate surface; and (e) advancing said one or more collected sheet articles from the collected position by operation of said one or more transport belts.

15. The method of claim 14 wherein said portion of said one or more transport belts and said one or more upper rollers pinch together said one or more collected sheet articles in the collected position therebetween for said portion of said one or more transport belts to advance said one or more collected sheet articles from the collected position.

16. The method of claim 14 wherein said step of paragraph (b) comprises utilizing one or more solenoid-activated rollers to engage and move said portion of said one or more transport belts.

17. The method of claim 14 wherein said steps of paragraphs (b) and (c) occur simultaneously.

18. The method of claim 14 wherein said one or more transport belts are continuously operating.

19. The method of claim 14 wherein said steps of paragraphs (c) and (d) occur simultaneously.

20. The method of claim 14 wherein moving said one or more stop brackets comprises moving said one or more stop brackets below said collector plate surface to allow said one or more sheet articles to be advanced thereby for advancement of said one or more sheet articles from the collected position.

21. A method of collecting one or more sheet articles on a collector apparatus and subsequently advancing said one or more sheet articles therefrom, said method comprising the steps of:

(a) advancing one or more sheet articles to a surface of a collector plate to collect said one or more sheet articles in a collected position on said collector plate surface in a horizontal plane;

(b) stopping advancement of said one or more collected sheet articles in the collected position on said collector plate surface by a pair of stop brackets positioned generally perpendicularly to said collector plate surface;

(c) lowering a pair of rollers positioned above said collector plate surface to engage at least one of said one or more collected sheet articles;

(d) simultaneously with the step of paragraph (c), moving said stop brackets to a position where said one or more collected sheet articles can be advanced from the collected position;

(e) simultaneously with the steps of paragraphs (c) and (d), raising at least a portion of each of a pair of transport belts positioned below said collector plate surface such that said portion of each of said transport belts passes through a different opening defined through said collector plate surface to engage at least one of said one or more collected sheet articles in the horizontal plane; and (f) advancing said one or more collected sheet articles from the collected position by operation of said transport belts.

* * * * *